United States Patent [19]

Loose et al.

[11] 4,045,843

[45] Sept. 6, 1977

[54] BUNDLE TIE DEVICES AND MATERIAL

[75] Inventors: Winfield Warren Loose, Linglestown; Anthony Francis Thomas, Harrisburg, both of Pa.

[73] Assignee: AMP Incorporated, Harrisburg, Pa.

[21] Appl. No.: 719,641

[22] Filed: Sept. 1, 1976

[51] Int. Cl.[2] ..... B65D 63/00

[52] U.S. Cl. ..... 24/16 PB

[58] Field of Search ..... 24/16 PB, 16 R, 17 R, 24/17 A, 17 B, 17 AP, 30, 5 P, 19, 20 TT, 735 A, 25, 206 A, 73 PB, 73 PF; 248/74 B, 74 PB; 150/3

[56] References Cited

U.S. PATENT DOCUMENTS

| | | | |
|---|---|---|---|
| 3,224,054 | 12/1965 | Lige | 248/74 PB |
| 3,438,095 | 4/1969 | Evans | 24/16 PB |
| 3,973,610 | 8/1976 | Bullin | 24/16 PB |

*Primary Examiner*—G. V. Larkin

*Attorney, Agent, or Firm*—Frederick W. Raring; Robert W. Pitts; Jay L. Seitchik

[57] ABSTRACT

A continuous strip of bundle tie material comprises a flat strip of thermoplastic having a generally channel shaped cross section. The upper surfaces of the sidewalls are provided with relatively fine ratchet teeth and the web of the strip has openings therein at regularly spaced intervals. In use, a section of the strip is passed around a bundle and one end is folded along the axis of the strip so that the fine ratchet teeth are directed outwardly and in opposite directions. The leading end is passed through an opening which is adjacent to the trailing end. The web material which is between the openings at the leading end forms coarse ratchet teeth for cooperation with the opening and the fine ratchet teeth cooperate with the opposed side edges of the opening. The fine ratchet teeth provide a fine or delicate adjustment so that the tie can be tightened on the bundle to the precise degree desired. The coarse ratchet teeth provide a safety feature to prevent removal of the tie from the bundle if the tie is subjected to extraordinary load conditions.

10 Claims, 8 Drawing Figures

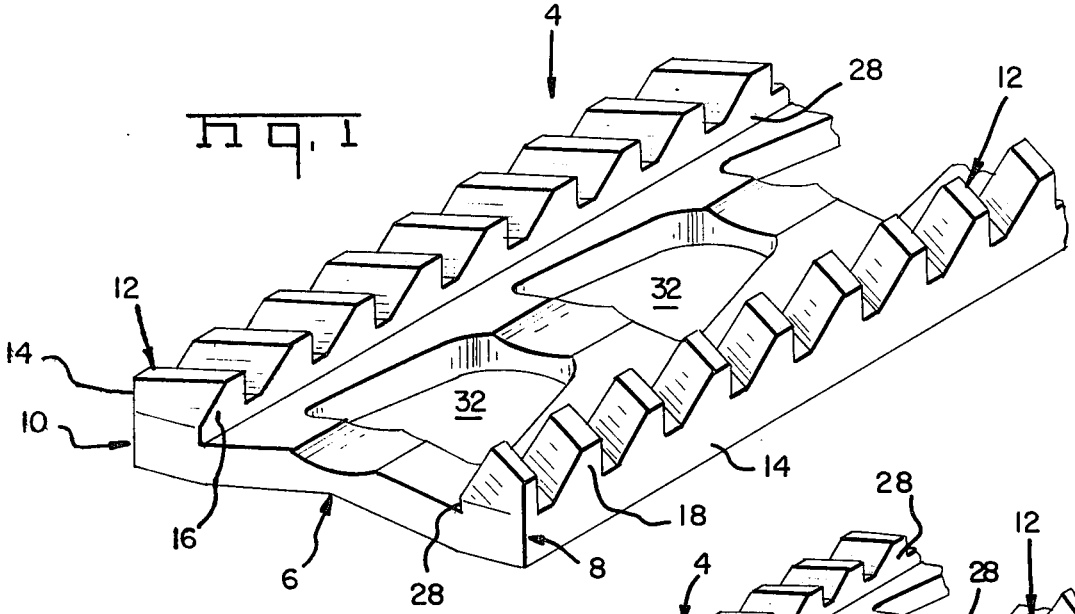
Fig. 1
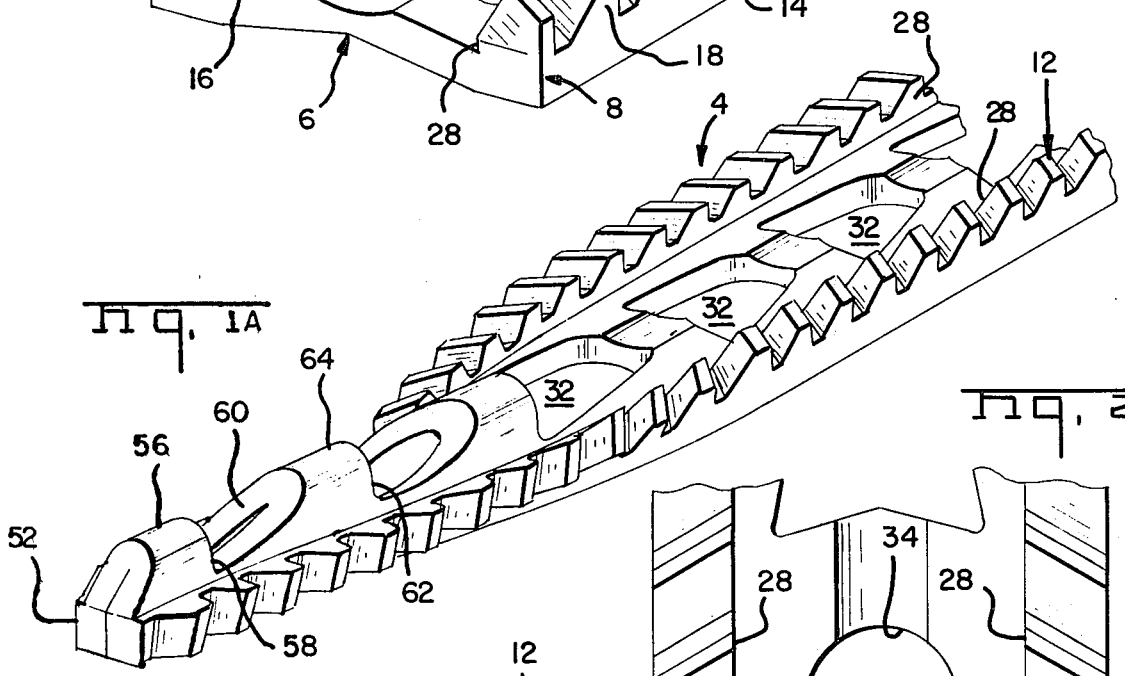
Fig. 1A
Fig. 2
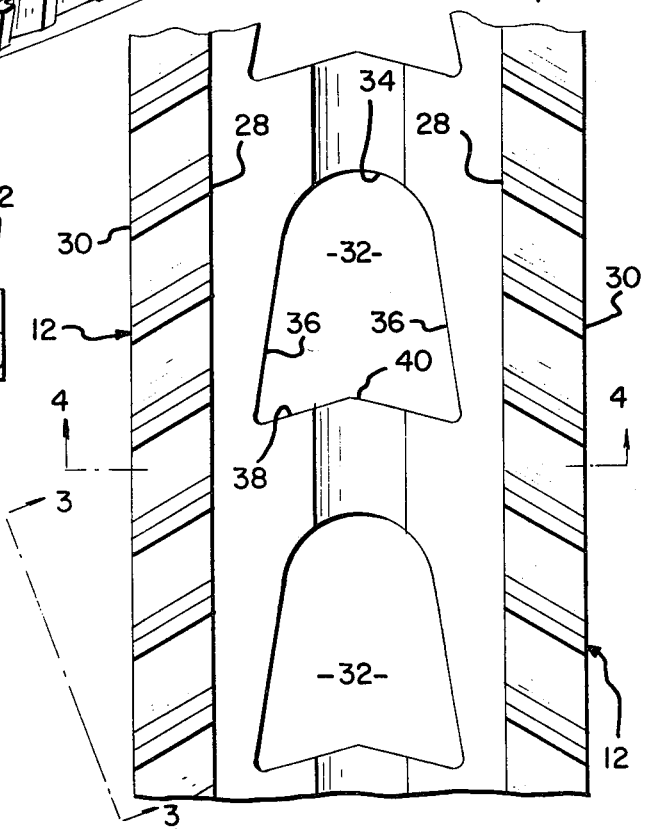
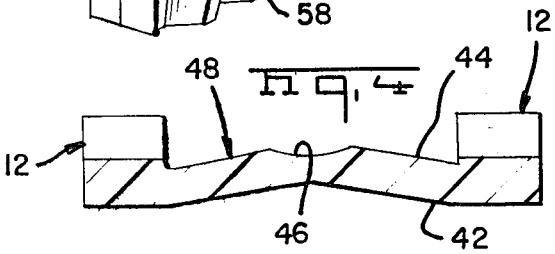
Fig. 4
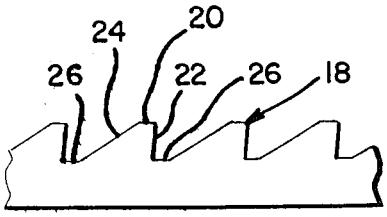
Fig. 3

BUNDLE TIE DEVICES AND MATERIAL

BACKGROUND OF THE INVENTION

This invention is directed to the achievement of a plastic bundle tie which can be manufactured in endless form so that only the precise amount of tie material required for a given bundling requirement is used. The embodiment of the invention described herein is particularly intended for use in bundling wires or similiar materials but a tie device in accordance with the invention can be used under many other circumstances.

Vast numbers of bundle tie devices are used in the electrical industry for bundling wires in harnesses at the time of assembly of the harness, for bundling wires in an apparatus after the wires have been assembled to the apparatus and for other purposes. Most, if not all, of the bundle tie devices presently being used are manufactured in discrete lengths and sizes by molding processes and these commonly used ties have a head portion with an opening therein through which the other end of the tie is threaded. A detent or ratcheting device is provided between the head and the running length of the tie so that the tie can be drawn taut on the bundle. The excess tie material is usually cut off and discarded after the tie has been applied to the bundle.

While this commonly available type of bundle tie device is satisfactory in many respects, it has the undesirable characteristic of being unnecessarily expensive and wasteful. This type of tie is wasteful in that the unused or excess length of the tie must be discarded after the tie has been applied to the bundle. Furthermore, a harness maker or other manufacturer who must provide bundle tie devices on bundles of varying sizes and containing varying numbers of wires must use different sizes of ties or different lengths of ties in his operations. This requirement that different lengths of bundle ties be used is burdensome financially and logistically, and it has long been recognized that a continuous tie would be desirable.

There have been several proposals for continuous tie devices but none of these prior art devices have received widespread acceptance, particularly in the electrical industry; see, for example, U.S. Pat. Nos. 3,224,054, 3,438,095, and 3,553,793.

In accordance with the principles of the instant invention, the tie device is provided as a continuous thermoplastic strip having a generally channel shaped cross section. Spaced, apart openings are provided in the web of the strip and fine ratchet teeth are provided on the surface of the sidewalls of the web of the strip. Any desired length of the tie can be used as a complete bundle tie by merely wrapping a section of the strip around a bundle, folding one end of the strip, and passing the folded end through an opening which is adjacent to the trailing end of the strip. The web material which is between adjacent openings and the edges of the openings in the folded section defines coarse ratchet teeth and the outwardly facing fine ratchet teeth on the sidewalls provide a second ratcheting device for the tie. The folded end is pulled through the opening in the trailing end until the tie is drawn taut on the bundle. The fine ratchet teeth permit the tie to be drawn to a precise degree of tautness and the coarse ratchet teeth provide a safety feature which would prevent removal of the tie from the bundle if the holding forces of the fine ratchet teeth should be overcome. The ratchet teeth and the openings are designed in a way such that the application of the tie to the bundle is relatively simple and the holding power of the tie compares favorably with that of previously known ties having separate head portions as described above.

It is accordingly an object of the invention to provide an improved bundle tie in the form of a continuous strip which can be used in any length desired. A further object is to provide a continuous strip of bundle tie material which can be manufactured at an extremely low cost. A still further object is to provide a continuous strip of bundle tie material which lends itself to application to a bundle by means of suitable relatively simple hand tools or more complex automatic applicator tools. A further object is to provide an improved continuous strip of bundle tie material which permits fine adjustment of the tightness of the tie on a bundle and which provides, in addition, a safety or overload feature to prevent removal of the tie from the bundle.

These and other objects of the invention are achieved in a preferred embodiment of the invention which is briefly described in the foregoing abstract, which is described in detail below, and which is shown in the accompanying drawing in which:

FIG. 1 is a perspective view of a section of bundle tie material in accordance with the invention.

FIG. 1A is a view similiar to FIG. 1 but showing the leading end of the strip folded to form coarse ratchet teeth.

FIG. 2 is a plan view of the strip of FIG. 1.

FIG. 3 and 4 are views taken along the line 3—3 and 4–4 respectively of FIG. 2.

Figure 5:
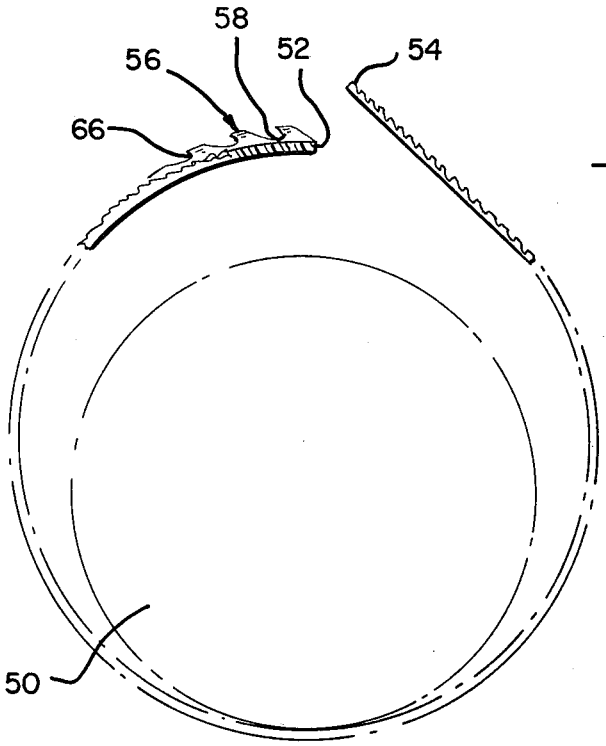
Figure 6:
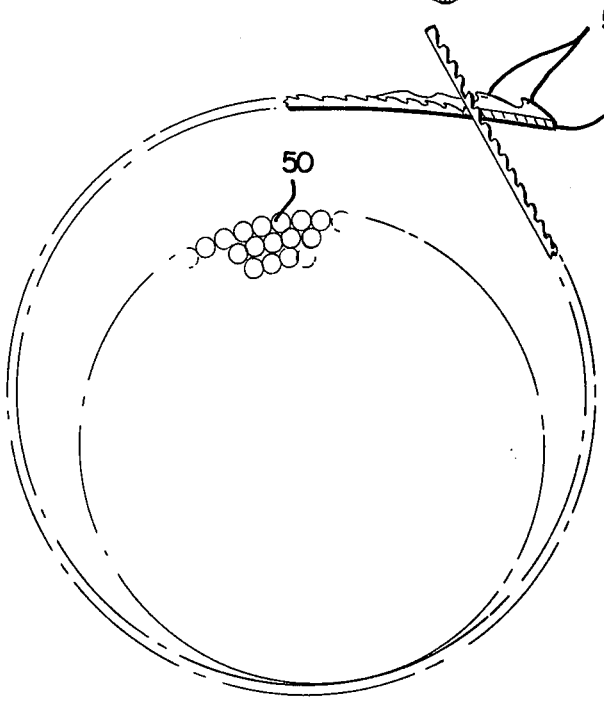

FIG. 5 and 6 are end views of a bundle of wires illustrating the manner of applying a bundle tie device in accordance with the invention to a bundle of wires.

Figure 7:
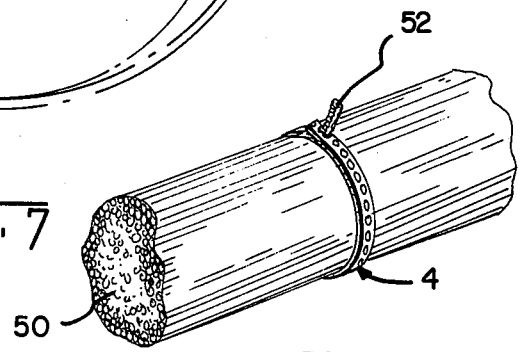

FIG. 7 is a perspective view of the bundle of wires having a bundle tie in accordance with the invention extending therearound.

Referring first to FIGS. 1–3, a preferred form of the invention comprises a continuous strip 4 a thermoplastic material having a generally channel-shaped cross section comprising a web 6 and upstanding sidewalls 8, 10. Each sidewall has an upwardly facing top surface 12, and outwardly facing external side surface 14, and an inwardly facing inside surface 16. The top surfaces 12 of the sidewalls are provided with continuous ratchet teeth 18, each tooth having a generally level crown 20, a sheer side 22, and a sloping side 24. Adjacent teeth are separated from each other by a root portion as shown at 26. The teeth 18 extend diagonally with respect to the longitudinal axis of the strip from their inner ends 28 which are adjacent to the internal sidewalls 16 to their outer ends 30. It should further be noted that the teeth on the left and right hand sidewalls as viewed in FIG. 2, extend convergently toward each other with respect to the longitudinal axis of the strip.

Holes or openings 32 are provided in the web 6 at regularly spaced intervals, each hole having a generally arcuate trailing edge 34 at one end thereof, divergent side edges 36 extending from the end edge 34, and a leading edge 38 which is at the leading end of each hole. The significance of the fact that the edges 38 define the leading end of each hole and the edges 34 define the trailing end will be explained below. It should be noted that portions of the trailing edge 38 on each side of the axis of the strip extend convergently toward the axis and in the same general direction as the teeth 18. In other words, the side edges 36 and the teeth 18 on each side of the axis of the strip slope in the same direction although the magnitudes of the slopes are different. The central portion 40 of the edge 38 defines a peak so that each hole 32 is of a somewhat reduced length as measured along the axis of the strip. This peak facilitates folding of the strip when it is applied to a bundle as shown in FIG. 5 and 6.

As shown in FIG. 1, the web 6 is inclined from the sidewalls 8, 10 upwardly towards the axis of the strip; as viewed in FIG. 4 and as shown at 42 and 44. The central portion of the web has an arcuate recess 46 therein and is, therefore, of somewhat reduced thickness. The continuous cross section shown in FIG. 4 exists only in those portions 48 of the web which lie between adjacent openings 32 and these portions of the web form the crown portions of coarse ratchet teeth which are formed when the strip is folded as will now be described.

When it is desired to provide an individual tie device on a bundle of wires 50, an appropriate length of tie material is cut from a continuous strip of material and passed around the bundle as shown in FIG. 5. The leading end 52 of this strip is identified by the orientation of the holes 32; specifically, the leading end is that end towards which the side edges 36 of the holes diverge and to which the leading ends 38 of the holes are proximate. The trailing end 54 is the end towards which the side edges 36 converge and to which the trailing ends 34 of the holes are proximate. The technician, in applying the tie device to the bundle 50, grasps the leading end 52 between his thumb and forefinger and presses the outwardly facing external surfaces 14 towards each other. In doing so, he will induce a portion of the strip at its leading end to collapse as shown in FIGS. 1A and 5 so that the surfaces 12 of the sidewalls will face outwardly and in opposite directions away from the strip. Because of the reduced thickness in the portions 46 of the web, the strip will collapse as described above and as shown in FIGS. 1A and 5 rather than in the opposite direction.

After collapse of the strip, a series of coarse ratchet teeth 56 will be formed by the edges 36 of the holes which are adjacent to the leading end and by the portions of the web material 48 which are adjacent to the leading ends. As shown in FIG. 1A, each tooth will have a root portion 58, an inclined section 60, and a crown portion 64. The inclined portion 60 is formed by the edges 36, 38 respectively and the crown portion 64 of each tooth is formed between web material 48 between adjacent openings. These coarse ratchet teeth 56 cooperate with the leading and trailing edges 34, 38 of a hole near the trailing end to provide a coarse ratchet device as described below.

After the leading end has been collapsed as shown in FIG. 1A, it is threaded through a selected hole 32 which is adjacent to the trailing end and pulled taut on the bundle. The fine ratchet teeth 18 will cooperate with the side edges 36 of the selected hole to provide a fine adjustment of the tightness of the tie and the coarse ratchet teeth 56 will be pulled through the opening. The edges of the hole resiliently deform as the crown portion of each coarse tooth is pulled therethrough. The holes 32 and the space between adjacent openings should be made such that the leading end can be pulled through the hole without undue effort but reverse motion or movement of the leading end should be prevented because of the sheer sides 66 of the coarse teeth. Specifically, the length of each hole as measured in the direction of the length of the strip should be slightly less than one half the width of the strip but sufficient to permit passage of the coarse ratchet teeth therethrough. It should also be noted that the inclination of the fine teeth 18 as viewed in FIG. 1A (upwardly and diagonally raised as viewed in FIG. 1A) facilitates movement of the leading end through the hole in the direction required for tightening the tie device on the bundle and discourages movement in the reverse direction.

As mentioned previously, the tie device shown in FIGS. 5-7 can be pulled taut to a relatively precise degree, that is, a fine adjustment of the tautness is provided by these teeth. The coarse teeth, on the other hand, provide a fail safe feature which would prevent removal of the tie from the bundle if the holding power of the fine teeth should be overcome by intentional or careless abuse, by the imposition of unexpected relatively high forces tending to strip the tie, or for other reasons.

In the foregoing description, it is assumed that a short section of tie device is applied to the wire bundle 50 without the aid of tools and in fact, it is entirely practical to apply a tie to a bundle in this manner. However, bundle tie material in accordance with the invention lends itself to the use of simple hand tools or to power driven hand tools of the general type which have been used. Under some circumstances, it may be practical to provide the tool with a magazine or other holder for a coil of bundling material and to design the tool such that the installed tie would not be cut from the coil until after the tie had been drawn taut on the bundle.

Bundle tie devices in accordance with the invention can be manufactured by a variety of methods, for example, by cold forming or hot forming an extruded strip of plastic to impress thereon the fine ratchet teeth on the sidewalls. Such an operation would be coupled with a punching operation to form the hole 32. A preferred method of manufacturing strip material in accordance with the invention is by continuous molding on a molding wheel as shown, for example, in U.S. Pat. No. 3,507,010. The holes 32 again are punched in the web.

Bundle tie devices in accordance with the invention can be made from any suitable thermoplastic material or composition having the requisite degree of strength and having sufficient flexibility to permit the strip to be wrapped around the bundle. As also mentioned above, the coarse ratchet teeth 56 and the portions of the web must be resiliently deformed when the leading end 52 of the bundle tie device is passed through the hole 32 adjacent to the trailing end. The material from which the device is manufactured should be sufficiently soft and resilient to permit this deformation. Good results have been obtained with an unfilled nylon material but other materials might be used such as polypropolene.

It is to be understood that the two ratcheting mechanisms provided by the coarse and fine teeth are independent of each other and that under some circumstances it may be desirable to use one or the other of these ratcheting mechanisms alone on a continuous strip. For example, where the strip is being made for extremely large bundles the coarse ratcheting mechanism alone may suffice and where the strip is being used on small bundles which are not subjected to severe conditions, the fine ratcheting mechanism may be used without the coarse mechanism.

What is claimed is:

1. A continuous length of bundle tie material comprising:

a continuous strip of plastic material having parallel side edges, said strip having holes therein at evenly spaced intervals, said holes being centrally located mid-way between said side edges and being symmetrical with respect to the longitudinal axis of said strip, one surface of said strip having thereon two bands of relatively fine ratchet teeth, each band extending along one of said side edges, said holes being sufficiently large to permit passage therethrough of an end portion of said strip which has been folded along said longitudinal axis with said bands facing outwardly of the folded end portion whereby, a section of said strip can be used as a bundle tie device by folding one end of said section along said longitudinal axis with said bands facing outwardly, wrapping said section around said bundle, threading said folded end through one of said holes in said strip, and pulling said folded end until said bundle is held by said section, said relatively fine ratchet teeth in said bands cooperating with edges of said hole to provide a ratchet mechanism for said tie.

2. Bundle tie material as set forth in claim 1, each of said holes being non-circular and having a leading edge, a trailing edge and side edges extending between said leading edge and said trailing edge.

3. Bundle tie material as set forth in claim 2, said leading edge being relatively wider than said trailing edge whereby said side edges of each hole extend convergently from said leading edge to said trailing edge.

4. Bundle tie material as set forth in claim 1, said strip having a substantially channel-shaped cross section comprising a web and sidewalls extending from said side edges, said sidewalls having free upper ends, said bands of relatively fine ratchet teeth being on said free ends.

5. Bundle tie material as set forth in claim 4, each of said holes having a leading edge, a trailing edge, and side edges extending between said leading and trailing edges, said leading edge being relatively wider than said trailing edge, said side edges of each hole extending convergently from said leading edge to said trailing edge, the length of each opening as measured along said longitudinal axis being less than one half the width of said strip whereby, upon folding the one end of a section of said strip to which said leading edges are proximate, coarse ratchet teeth are formed by the web material of said strip, said coarse ratchet teeth cooperating with said leading and trailing edges said one hole to provide an additional ratchet mechanism.

6. A continuous length of bundle tie material comprising:

a continuous strip of plastic material, said strip having a substantially channel-shaped cross section comprising a web and sidewalls extending from the side edges of said web, each of said sidewalls having an upper surface, an outwardly facing outside surface, and an inwardly facing inside surface, said web extending from said inwardly inside surfaces and being inclined upwardly towards the longitudinal axis of said strip, said web having a section of reduced thickness at said longitudinal axis, said web having holes therein at regularly spaced intervals, said holes each having a leading end, a trailing end, said leading end being relatively wider than said trailing end, side edges extending between said ends, said side edges extending convergently from said leading end to said trailing end whereby the widths of each of said holes decreases from its leading end to its trailing end, said holes being symmetrical with respect to said longitudinal axis and said leading ends being directed in a common direction with respect to the length of said strip, adjacent holes in said web being separated by a section of web material, each of said upper surfaces of said sidewalls having fine ratchet teeth thereon, said ratchet teeth extending diagonally outwardly and divergently with respect to said common direction from the inside edge of each top surface to the outside edge of said top surface whereby, upon cutting a section of said strip, folding the end portion of said section to which said leading ends of said holes are proximate so that said sidewalls are against each other and said fine ratchet teeth face outwardly, the sections of web material in said leading end between adjacent openings will form coarse ratchet teeth, and upon positioning said section against a bundle with said ratchet teeth facing outwardly, wrapping said section around said bundle, threading said leading end through an opening which is adjacent to the trailing end of said section, and pulling on said leading end, said coarse ratchet teeth will cooperate with said opening and said fine ratchet teeth will cooperate with said side edges of said opening to provide a bundle tie having ratchet type lock, said fine ratchet teeth in said side edges defining the minimum ratcheting increment and said coarse ratchet teeth defining an additional ratchet means to hold said tie on said bundle.

7. A continuous length of bundle tie material as set forth in claim 6, each of said holes having a leading edge which defines said leading end, said leading edge of each hole merging with convergent edge portions on each side of said longitudinal axis which extending convergently in said common direction.

8. A continuous length of plastic material as set forth in claim 7, said trailing end of each hole being defined by a trailing edge, said trailing edge being arcuate and being concave in said common direction.

9. A bundle tie device comprising:

a strip of plastic material, said strip having a substantially channel-shaped cross section comprising a web and sidewalls extending from the side edges of said web, each of said sidewalls having an upper surface, an outwardly facing outside surface, and an inwardly facing inside surface, said web extending from said inwardly inside surfaces and being inclined upwardly towards the longitudinal axis of said strip, said web having a section of reduced thickness at said longitudinal axis, said web having holes therein at regularly spaced intervals, said holes each having a leading end, a trailing end, said leading end being relatively wider than said trailing end, side edges extending between said ends, said side edges extending convergently from said leading end to said trailing end whereby the widths of each of said holes decreases from its leading end to its trailing end, said holes being symmetrical with respect to said longitudinal axis and said leading ends being directed in a common direction with respect to the length of said strip, adjacent holes in said web being separated by a section of web material, each of said upper surfaces of said sidewalls having fine ratchet teeth thereon, said fine ratchet teeth extending diagonally outwardly and divergently with respect to said common direction from the inside edge of each top surface to the outside edge of said top surface, said strip having a leading end and a trailing end, said leading end being the end to which said leading ends of said holes are proximate, said leading end being folded along said axis so that said fine ratchet teeth face outwardly from said axis, portions of said web adjacent to said leading end forming coarse ratchet teeth, said device being wrapped around a bundle with said folded leading end extending through one of said holes which is adjacent to said trailing end, said coarse and fine ratchet teeth cooperating with edge portions of said one hole to provide ratchet means serving to retain said device on said bundle.

10. A bundle tie device comprising:

a strip of plastic material, said strip having a leading end and a trailing end, said strip having a substantially channel-shaped cross section comprising a web and sidewalls extending from the side edges of said web, each of said sidewalls having an upper surface, an outwardly facing surface and an inwardly facing inside surface, each of said upper surfaces having ratchet teeth thereon, said ratchet teeth extending diagonally outwardly and divergently, said web having a hole therein adjacent to said trailing end, said hole being dimensioned to receive said leading end upon folding said leading end so that said ratchet teeth are directed outwardly in opposite directions and threading said leading end through said hole, whereby, said tie device can be applied to a bundle by passing said device around said bundle, folding said leading end, and passing said leading end through said hole in said trailing end so that said ratchet teeth engage side edge portions of said hole to retain said bundle tie device in embracing relationship to said bundle.

* * * * *